US009538899B2

(12) United States Patent
Kokbiyik et al.

(10) Patent No.: US 9,538,899 B2
(45) Date of Patent: Jan. 10, 2017

(54) DISHWASHER COMPRISING A MICROFILTER

(75) Inventors: Ismail Kokbiyik, Istanbul (TR); Orhan Atabey, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 960 days.

(21) Appl. No.: 13/499,684

(22) PCT Filed: Sep. 29, 2010

(86) PCT No.: PCT/EP2010/064455

§ 371 (c)(1),
(2), (4) Date: Mar. 30, 2012

(87) PCT Pub. No.: WO2011/039253

PCT Pub. Date: Apr. 7, 2011

(65) Prior Publication Data

US 2012/0180824 A1 Jul. 19, 2012

(30) Foreign Application Priority Data

Oct. 1, 2009 (TR) ..... a 2009 07476

(51) Int. Cl.
*A47L 15/42* (2006.01)

(52) U.S. Cl.
CPC ..... *A47L 15/4208* (2013.01); *A47L 15/4206* (2013.01)

(58) Field of Classification Search
CPC ..... A47L 15/4208; A47L 15/4206
USPC ..... 134/56 D, 57 D, 58 D, 110, 111
See application file for complete search history.

(56) References Cited

U.S. PATENT DOCUMENTS

| | | | | |
|---|---|---|---|---|
| 3,402,576 | A * | 9/1968 | Krupsky | 68/4 |
| 2002/0014260 | A1* | 2/2002 | Kim et al. | 134/104.1 |
| 2004/0103925 | A1* | 6/2004 | Marettek | 134/56 D |
| 2008/0283099 | A1* | 11/2008 | Peukert et al. | 134/99.1 |

FOREIGN PATENT DOCUMENTS

| | | | |
|---|---|---|---|
| DE | 3745169 | C2 * | 7/1999 |
| EP | 1386575 | A1 * | 2/2004 |

OTHER PUBLICATIONS

Machine translation of DE 3745169 C2 to Fumagalli, Jul. 1997.*

* cited by examiner

*Primary Examiner* — Michael Barr
*Assistant Examiner* — Benjamin L Osterhout
(74) *Attorney, Agent, or Firm* — Kilpatrick Townsend & Stockton LLP

(57) ABSTRACT

The dishwasher (1) of the present invention comprises a washing tub (2) wherein items to be washed are placed, a receptacle (3) located at the lower portion of the washing tub (2), a microfilter (5) located in the middle of the receptacle (3), which allows the passing of the water but which holds the residues carried by the water, a circulation pump (4) which returns the water accumulated in the receptacle (3) to the washing tub (2), a suction hose (7) one end of which opens to the circulation pump (4), the other to the receptacle (3), a suction hole (9) to which the end of the suction hose (7) which opens into the receptacle (3) is mounted, and a supply hose (6) one end of which is connected to the mains and the other end of which opens to the receptacle (3). Fresh water from supply hose (6) is directed to the outer surface of the microfilter (5) in order to wash deposits from the internal filter surface.

6 Claims, 2 Drawing Sheets

DISHWASHER COMPRISING A MICROFILTER

Figure 1:
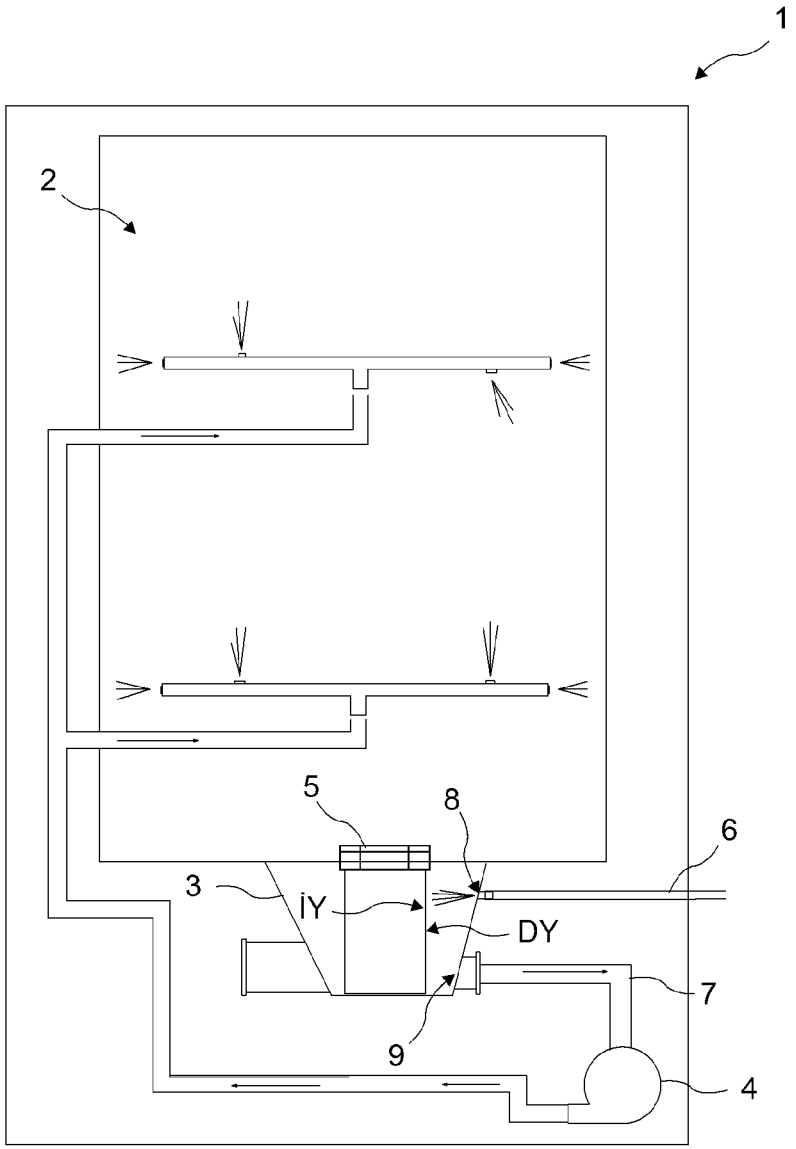

The present invention relates to a dishwasher comprising a microfilter.

The microfilter used in a dishwasher clogs due to the residues adhering thereon as a result of consecutive washings. This decreases, after a while, the washing performance of the dishwasher and makes the filtration system dysfunctional. To prevent this, the user is required to remove and clean the microfilter at certain periods. But many users either never clean the microfilter or cannot replace it properly after the cleaning. The microfilter not being cleaned or its erroneous assembly causes the decrease in the washing performance. For this reason, in the state of the art, various solutions have been developed for the microfilter to self-clean.

In the state of the art, a washing receptacle is situated at the lower portion of the washing tub, wherein the water in the washing tub is collected during the washing process and in the middle of which the microfilter is placed. The circulation pump which is used to return the water collected in the washing receptacle to the washing tub is connected to the washing receptacle by means of a suction hose one end of which opens to the pump, the other to the washing receptacle. A supply hose which provides the washing water to be taken into the washing tub from mains by one end being connected to the mains such that it is connected almost opposite to the wall to which the circulation pump is connected to the washing receptacle and the other end of which opens to the washing receptacle.

Since the circulation pump sucks the water in the washing receptacle by means of the suction hose, residues entering into the microfilter accumulate more than at the inner part of the washing receptacle located at the side of the wall thereof to which the suction hose is connected in comparison with the other side. The water taken from the mains by the supply hose does not provide the cleaning of the residues adhering to this wall, on the contrary sticks them to the wall of the microfilter.

The aim of the present invention is the realization of a dishwasher comprising a microfilter which can be cleaned without requiring user intervention.

The dishwasher realized in order to attain the aim of the present invention, explicated in the first claim and the respective claims thereof, comprises a water inlet hole which is located on the same wall with the suction hole through which the circulation pump is connected to the receptacle, at almost the same vertical direction, at a higher level than the suction hole. The water inlet hole is situated on the receptacle wall such as to spray water on the outer surface of the microfilter facing the suction hole.

Thus, the residues accumulated on the inner surface of the microfilter are provided to be cleaned by the water flow to which the microfilter is subjected at the opposite direction from the other side of the same surface. Thus, the microfilter is cleaned by pushing the residues adhering to the inner surface of the microfilter by means of the water moving through the supply hose to the receptacle when water is taken into the washing tub from the mains.

In another embodiment of the present invention, the water inlet hole to which the supply hose is connected is in nozzle form. Thus, by increasing the speed of the water coming from the supply hose by means of mains pressure and thus by the water hitting the outer surface of the microfilter faster, the residues accumulated on the other side of the same surface are provided to be removed from the microfilter.

In another embodiment of the present invention, the cleaning of the microfilter is realized just after the main washing step. The water taken from the mains is discharged after being passed through the microfilter.

By means of the present invention, the accumulation of residue on the microfilter surface decreases. Moreover, the residues accumulated are provided to be dispersed almost homogeneously on all the surfaces of the microfilter. Thus, the decrease in the washing performance of the dishwasher after consecutive washings is prevented.

A dishwasher realized in order to attain the aim of the present invention is illustrated in the attached figures, where:

FIG. 1—is the schematic view of a dishwasher.

Figure 2:
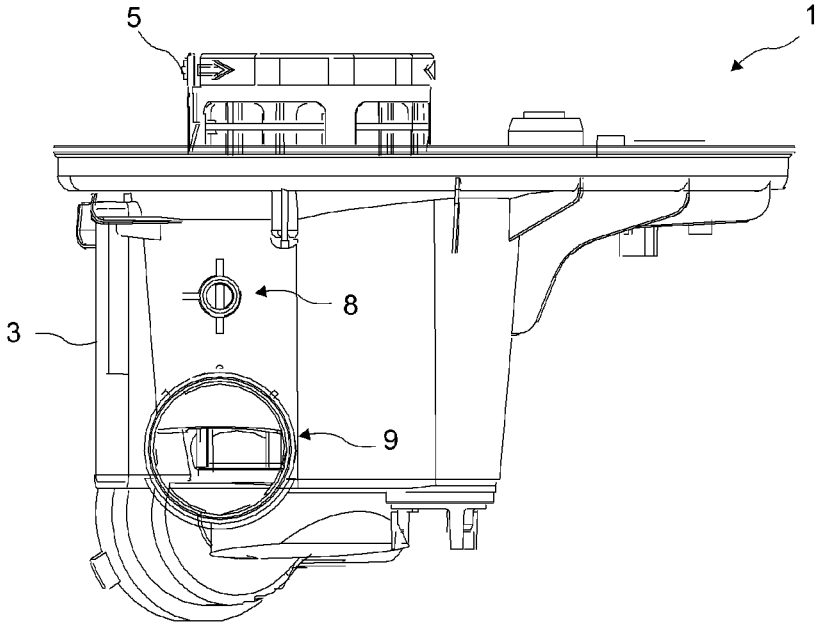

FIG. 2—is the front view of a receptacle.

Figure 3:
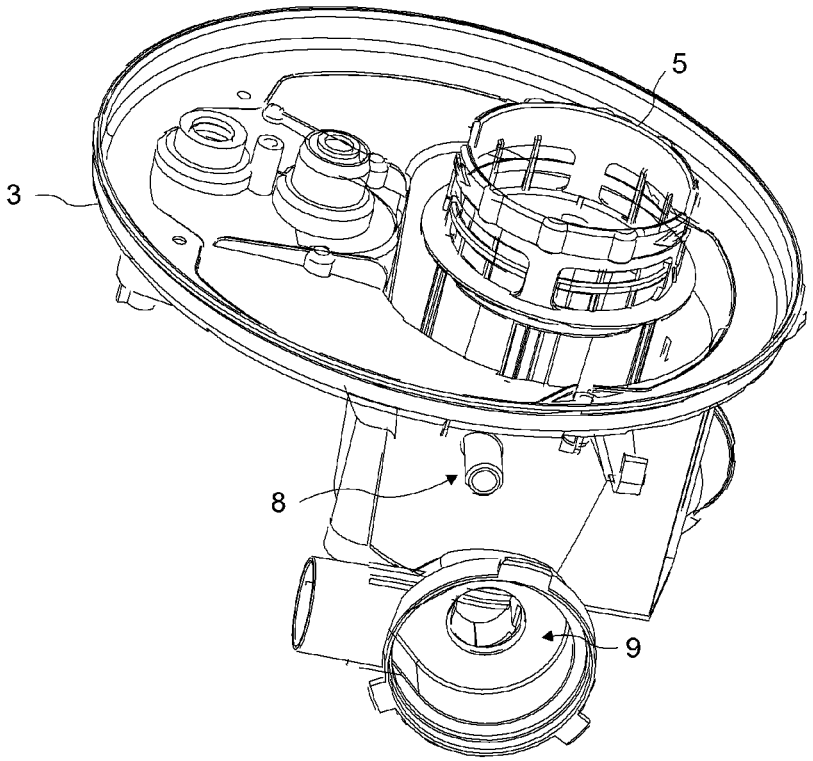

FIG. 3—is the perspective view of the receptacle.

The elements illustrated in the figures are numbered as follows:

1. Dishwasher
2. Washing tub
3. Receptacle
4. Circulation pump
5. Microfilter
6. Supply hose
7. Suction hose
8. Water inlet hole
9. Suction hole The dishwasher (1) of the present invention comprises a washing tub (2) wherein items to be washed are placed, a receptacle (3) located at the lower portion of the washing tub (2), wherein the water in the washing tub (2) is collected during the washing process, a microfilter (5) located in the middle of the receptacle (3), which allows the passing of the water which passes from the washing tub (2) to the receptacle (3) but which holds the residues carried by the water, a circulation pump (4) which returns the water accumulated in the receptacle (3) to the washing tub (2), a suction hose (7) one end of which opens to the circulation pump (4), the other to the receptacle (3), a suction hole (9) to which the end of the suction hose (7) which opens into the receptacle (3) is mounted, and which opens to the receptacle (3) wall facing the microfilter (5) such that the water accumulated in the receptacle (3) can pass to the suction hose (7), and a supply hose (6) one end of which is connected to the mains and the other end of which opens to the receptacle (3).

The dishwasher (1) furthermore comprises a water inlet hole (8) to which the end of the supply hose (6) opening to the receptacle (3) is mounted, which opens above the suction hole (9), which is located almost at the same vertical direction with the suction hole (9), which faces the outer surface (DY) of the microfilter (5). The water inlet hole (8) and the suction hole (9) are situated on the receptacle (3) wall facing the outer surface (DY) of the microfilter (5) (FIG. 1).

The water sucked by the circulation pump (4) reaches the suction hole (9) after passing over the microfilter (5) and is directed to the washing tub (2) by passing through the circulation pump (4) after passing through the suction hose (7). When water is taken from the mains, the water passing through the supply hose (6) reaches the receptacle (3) by passing through the water inlet hole (8) and enters into the receptacle (3) by hitting the microfilter (5) just in front of the water inlet hole (8). Thus, as the circulation pump (4) operates, the residues remaining on the inner surface (İIY) of the microfilter (5) in the water suction direction leave the inner surface (İY) of the microfilter (5) by the water taken into the receptacle (3) in a direction opposite to the water suction direction hitting the outer surface (DY) of the microfilter (5).

While the dishwasher (1) operates, the water accumulated in the receptacle (3) is sucked by means of the circulation pump (4) and sent to the propellers. While the water accumulated in the receptacle (3) is sucked by means of the circulation pump (4), residues carried by the water accumulate on the inner surface (İY) of the wall of the microfilter (5) in the middle of the receptacle (3), which is located in the water suction direction. The water inlet hole (8) located just above the suction hole (9) is situated opposite the microfilter (5) wall facing the suction hole (9). In this case, when the circulation pump (4) operates, the residues accumulated on the inner surface (İY) of the microfilter (5) by the water being sucked by the circulation pump (4) are moved away from the inner surface (İY) of the microfilter (5) by the water taken from the mains hitting the outer surface (DY) of the microfilter (5) right after flowing at the opposite direction to the suction direction of the circulation pump (4). Thus, the residues accumulated on the inner surface (İY) of the microfilter (5) are moved away from the inner surface (İY) by the water taken from the mains hitting the outer surface (DY) of the same wall of the microfilter (5) and thus providing the microfilter (5) to be cleaned without user intervention.

In another embodiment of the present invention, the water inlet hole (8) is in nozzle form narrowing towards the inside of the receptacle (3). Thus, the speed of the water taken from the mains by means of the supply hose (6) is increased to be taken into the receptacle (3) and to hit the outer surface (DY) of the microfilter (5).

In another embodiment of the present invention, the dishwasher (1) has a control unit which provides the microfilter (5) to be cleaned by taking water from the water inlet hole (8) before the rinsing step and after the main washing step is completed. Thus, by taking water from the mains by means of the supply hose (6) and the water taken into the receptacle (3) through the water inlet hole (8) hitting the outer surface (DY) of the microfilter (5) after the main washing step is completed, the residues accumulated on the inner surface (İY) of the microfilter (5) during the main washing step are provided to be moved away from the inner surface (İY) of the microfilter (5). In this embodiment of the present invention, after taking preferably 1.1 liters of water three times from the mains, the water is discharged.

It is to be understood that the present invention is not limited to the embodiments disclosed above and a person skilled in the art can easily introduce different embodiments. These different embodiments should be considered within the scope of the claims of the present invention, too.

The invention claimed is:

1. A dishwasher (1) comprising a washing tub (2) wherein items to be washed are placed, a receptacle (3) located at the lower portion of the washing tub (2), herein the water in the washing tub (2) is collected during the washing process, a microfilter (5) located in the middle of the receptacle (3), which allows the passing of the water which passes from the washing tub (2) to the receptacle (3) but which holds the residues carried by the water, a circulation pump (4) which returns the water accumulated in the receptacle (3) to the washing tub (2), a suction hose (7) one end of which opens to the circulation pump (4), the other to the receptacle (3), a suction hole (9) to which the end of the suction hose (7) which opens into the receptacle (3) is mounted, and which opens to the receptacle (3) wall facing the microfilter (5) such that the water accumulated in the receptacle (3) can pass to the suction hose (7), and a supply hose (6) one end of which is connected to the mains and the other end of which opens to the receptacle (3), characterized by a water inlet hole (8) to which the end of the supply hose (6) which opens into the receptacle (3) is mounted, which opens above the suction hole (9) on the receptacle (3) wall, which is located substantially at the same vertical direction with the suction hole (9), at a higher level than the suction hole (9), which faces the outer surface (DY) of the microfilter (5).

2. The dishwasher (1) as in claim 1, wherein the water inlet hole (8) is in nozzle form narrowing towards the inside of the receptacle (3).

3. The dishwasher (1) as in claim 1, further comprising a control unit providing water from the water inlet hole (8) before a rinsing step and after completion of a main washing step to clean the microfilter (5).

4. A dishwasher (1) comprising a washing tub (2) wherein items to be washed are placed, a receptacle (3) located at the lower portion of the washing tub (2), herein the water in the washing tub (2) is collected during the washing process, a microfilter (5) located in the middle of the receptacle (3), which allows the passing of the water which passes from the washing tub (2) to the receptacle (3) but which holds the residues carried by the water, a circulation pump (4) which returns the water accumulated in the receptacle (3) to the washing tub (2), a suction hose (7) one end of which opens to the circulation pump (4), the other to the receptacle (3), a suction hole (9) to which the end of the suction hose (7) which opens into the receptacle (3) is mounted, and which opens to the receptacle (3) wall facing the microfilter (5) such that the water accumulated in the receptacle (3) can pass to the suction hose (7), and a supply hose (6) one end of which is connected to the mains and the other end of which opens to the receptacle (3), characterized by a water inlet hole (8) to which the end of the supply hose (6) which opens into the receptacle (3) is mounted, which opens above the suction hole (9) on the receptacle (3) wall, which is located directly above at the same vertical direction with the suction hole (9), at a higher level just above the suction hole (9), wherein the suction hole faces the outer surface (DY) of the microfilter (5).

5. The dishwasher (1) as in claim 4, wherein the water inlet hole (8) is in nozzle form narrowing towards the inside of the receptacle (3).

6. The dishwasher (1) as in claim 4, further comprising a control unit providing water from the water inlet hole (8) before a rinsing step and after completion of a main washing step to clean the microfilter (5).

* * * * *